US010376922B1

(12) United States Patent
Snow

(10) Patent No.: US 10,376,922 B1
(45) Date of Patent: Aug. 13, 2019

(54) MATERIAL SEPARATORS

(71) Applicant: Michael David Snow, Bend, OR (US)

(72) Inventor: Michael David Snow, Bend, OR (US)

( * ) Notice: Subject to any disclaimer, the term of this patent is extended or adjusted under 35 U.S.C. 154(b) by 0 days.

(21) Appl. No.: 15/881,010

(22) Filed: Jan. 26, 2018

(51) Int. Cl.
*B07B 1/16* (2006.01)
*B07B 1/46* (2006.01)

(52) U.S. Cl.
CPC . *B07B 1/16* (2013.01); *B07B 1/46* (2013.01)

(58) Field of Classification Search
CPC ..... B07B 1/16; B07B 1/46
USPC ..... 209/392, 393, 394, 396
See application file for complete search history.

(56) References Cited

U.S. PATENT DOCUMENTS 3,971,716 A * 7/1976 Foreman ..... B07B 1/16 209/396
5,322,170 A * 6/1994 Hadden ..... B07B 1/005 209/314
6,098,811 A * 8/2000 Schaefer ..... B07B 1/50 209/395
6,357,597 B1 * 3/2002 Theeler, Sr. ..... B07B 1/46 209/393
6,712,218 B2 3/2004 Nierop
7,537,123 B2 5/2009 Snow
7,861,867 B1 * 1/2011 Derrick ..... B07B 1/12 209/393
2007/0256960 A1 * 11/2007 Dees ..... B07B 1/005 209/393
2010/0059416 A1 * 3/2010 Snow ..... B07B 1/12 209/414

* cited by examiner

*Primary Examiner* — Terrell H Matthews
(74) *Attorney, Agent, or Firm* — Leber IP Law; Celia H. Leber

(57) ABSTRACT

The disclosure features material separators for screening excavated material (e.g., rocks from soil.) In some implementations the materials separators include (a) a supporting frame; (b) a screening surface mounted at an incline on the supporting frame, the screening surface comprising a plurality of fixed bars that are attached to the frame in a manner to resist upward movement, and a plurality of shift bars that are attached to the frame at their upper and lower ends, in a manner to allow upward movement; and (c) a shift bar actuator, positioned between the upper and lower ends of the shift bars, the shift bar actuator being configured to impart a two-stage movement to the shift bars, whereby during a first stage the upper ends are first displaced vertically, and during a second stage the lower ends pivot upward about the upper ends.

11 Claims, 23 Drawing Sheets

MATERIAL SEPARATORS

BACKGROUND

The present disclosure pertains to material separators, and in particular to rock/soil separators for use during excavation.

Material separators for separating rocks from finer material, also known as "grizzly" separators, allow an operator of a loader (e.g., an excavator, backhoe, front end loader, etc.) to dump a bucket load of excavated material on an inclined screening surface to screen rocks, rubble, debris and other large material from soil that, once screened, can be used, e.g., as backfill or landscape topsoil. The screening surface is mounted at an incline on a supporting frame, and is generally comprised of a number of parallel bars, the lengths of which extend generally in the direction of the incline.

An example of such a separator is described in U.S. 2010/0059416, the full disclosure of which is incorporated herein by reference. In the separator described in U.S. 2010/0059416 some of the bars are attached to the supporting frame (fixed bars), while alternating bars are movable relative to the frame (shift bars.) The shift bars are mounted such that they can pivot about their upper ends, allowing the lower ends to be lifted away from the supporting frame to free trapped rocks and other large material from the screening surface. Lifting may be accomplished, for example, by placing the bucket of a loader under an actuator, e.g., a lift bar to which the shift bars are bolted, and pushing upward. The lift bar is generally located relatively close to the lower ends of the shift bars, so as to maximize the lever arm about the pivot point.

In some cases, the spacing between the bars is adjustable. However, this generally requires unbolting each of the bars from the lift bar, or undoing fasteners that attach the bars to the frame.

SUMMARY

The present disclosure features material separators that include features that enhance operator efficiency and safety. In some implementations, the separators include shift bars that can be raised with a two-stage "rocking" movement that facilitates freeing of material trapped between the bars of the screening surface. The separators may also feature improved ease of adjustability of the lateral spacing of the bars of the screening surface.

In one aspect, the disclosure features a material separator that includes: (a) a supporting frame; (b) a screening surface mounted at an incline on the supporting frame, the screening surface comprising a plurality of fixed bars that are attached to the frame in a manner to resist upward movement, and a plurality of shift bars that are attached to the frame at their upper and lower ends, in a manner to allow upward movement; and (c) a shift bar actuator, positioned between the upper and lower ends of the shift bars, the shift bar actuator being configured to impart a two-stage movement to the shift bars, whereby during a first stage the upper ends are first displaced vertically, and during a second stage the lower ends pivot upward about the upper ends.

Some implementations of this aspect of the disclosure may include one or more of the following features.

Each of the upper ends of the shift bars may include a guide plate that is interposed between a pair of vertical plates that are mounted on the frame, with the guide plate moving upward relative to the vertical plates during the first stage. At the end of the first stage further upward movement of each of the upper ends can be prevented by a pin that extends through the guide plate and vertical plates, and about which pivoting occurs during the second stage. In some cases, the vertical plates extend from attach plates that are bolted to the frame to allow adjustment of the lateral positioning of the upper ends of the shift bars.

In some implementations, the shift bar actuator is positioned closer to the upper ends of the shift bars than the lower end. The shift bar actuator may be pivotably mounted on a deck bar support member that is welded to the frame, and the shift bar actuator may be configured to pivot upward relative to the deck bar support member in response to a force applied to a lower surface of the shift bar actuator. Pivotable mounting may be accomplished by a plurality of hinges positioned along the length of the shift bar actuator. One or more stop(s) may be provided to prevent the shift bar actuator from contacting the deck bar support member when the shift bar actuator is returned to a rest position.

The separator may also include T-supports mounted on lower surfaces of the shift bars and fixed bars, each T-support having a length that extends substantially perpendicular to the length of the deck bar support and a cross-bar positioned to contact an upper surface of the deck bar support when the shift bars are in a rest position. In some cases, the T-supports mounted on the shift bars are longer than the T-supports mounted on the fixed bars to an extent that the T-supports on the shift bars also contact the shift bar actuator, while the T-supports on the fixed bars only contact the deck bar support.

The separator may also include a fixed central bar that is welded to the frame, and a stop extending downwardly from the fixed central bar to limit upward movement of the shift bar actuator.

In another aspect, the disclosure features a material separator that includes (a) a supporting frame comprising upper and lower frame members; and (b) a screening surface mounted at an incline on the supporting frame, the screening surface comprising a plurality of deck bars having upper and lower ends that are attached to the upper and lower frame members. In this aspect, the deck bars are attached to the supporting frame only at their upper and lower ends, and are not attached to each other along their length.

Some implementations of this aspect of the disclosure may include any of the features discussed above, and/or one or more of the following features.

The deck bars may be attached to the supporting frame by attach plates that are bolted to the upper and lower frame members and slidably mounted thereon, to allow adjustment of the lateral spacing of the upper and lower ends of the deck bars by unbolting the attach plates and sliding the attach plates laterally on the frame members.

The deck bars may be supported along their lengths by a deck bar support member that is welded to the frame and extends substantially parallel to the upper and lower frame members. The deck bars are not attached to the deck bar support. In some cases, the deck bars include T-supports that rest on an upper surface of the deck bar support.

In another aspect, the disclosure features a material separator that includes: (a) a supporting frame; (b) a screening surface mounted at an incline on the supporting frame, the screening surface comprising a plurality of fixed bars that are attached to the frame in a manner to resist upward movement, and a plurality of shift bars that are attached to the frame at their upper and lower ends, in a manner to allow upward movement; (c) a shift bar actuator, positioned between the upper and lower ends of the shift bars, the shift bar actuator being configured to impart movement to the shift bars; and (c) a deck bar support member, fixedly mounted to the frame and extending generally parallel to the shift bar actuator. In this aspect, the shift bar actuator is pivotably mounted on the deck bar support member, and the deck bar support member and shift bar actuator are positioned closer to the upper ends of the shift bars than the lower ends of the shift bars.

Some implementations of this aspect of the disclosure may include any of the features discussed above.

The disclosure also features methods of using the separators to screen material, and to free material trapped between the deck bars by moving the shift bars relative to the fixed bars. Some methods include adjusting the spacing between the deck bars, and/or removing or adding deck bars, by unbolting the attach plates referred to above.

DETAILED DESCRIPTION

Figure 1:
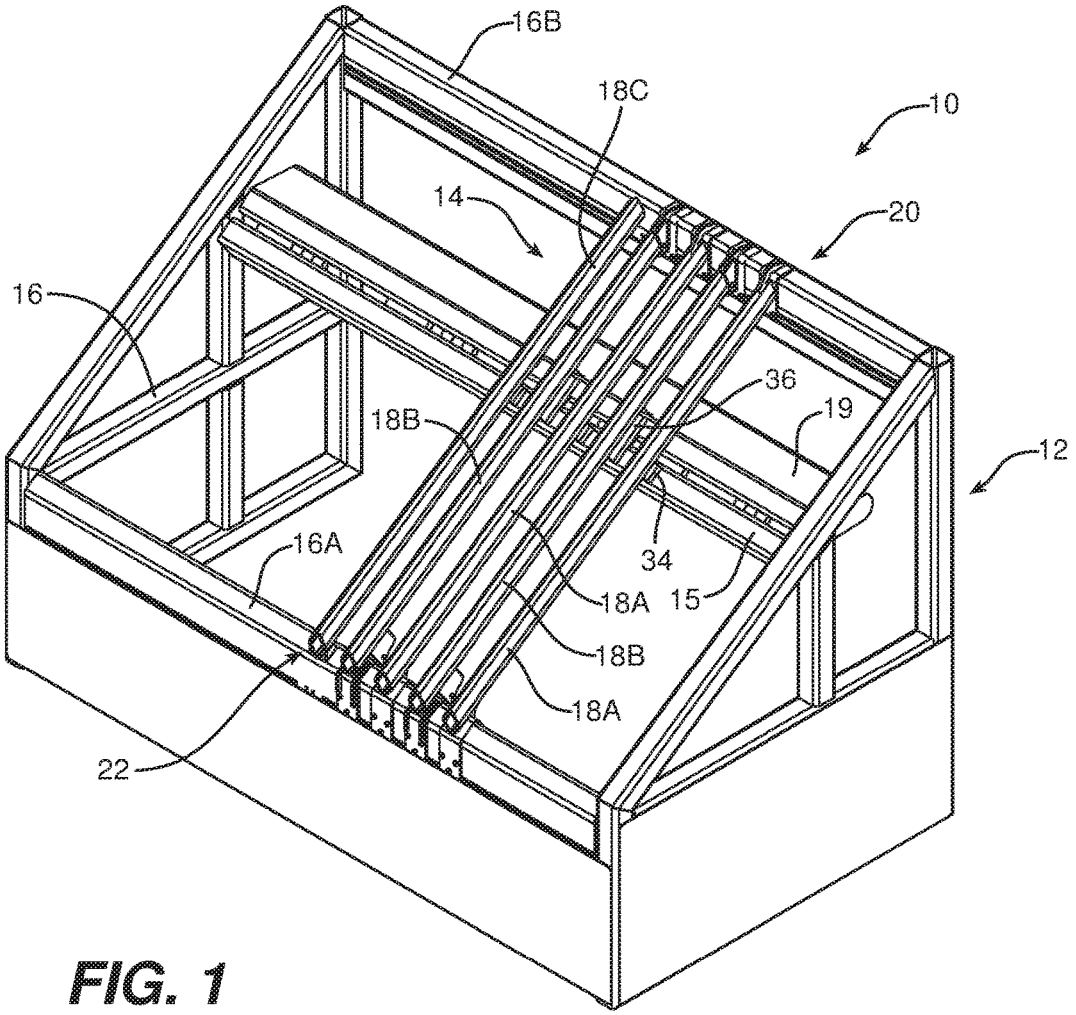
FIG. 1 is a perspective view of a material separator according to one implementation, with some of the inclined deck bars removed for clarity.

Referring to FIG. 1, a material separator 10 includes a supporting frame 12 and a screening surface 14 that is inclined relative to the horizontal members 16 of the frame 12. The angle of the incline may be, for example, from about 20 to 50 degrees, e.g., from about 30 to 40 degrees, as is well known in the material separator art.

The screening surface 14 is comprised of a plurality of elongated deck bars 18, the lengths of which are generally parallel to the direction of incline of the screening surface. Only a few of the bars are shown in FIG. 1; in the actual material separator 10 more bars are included, parallel to those that are shown, to form a continuous screening surface from one side of the frame to the other.

Figure 1A:
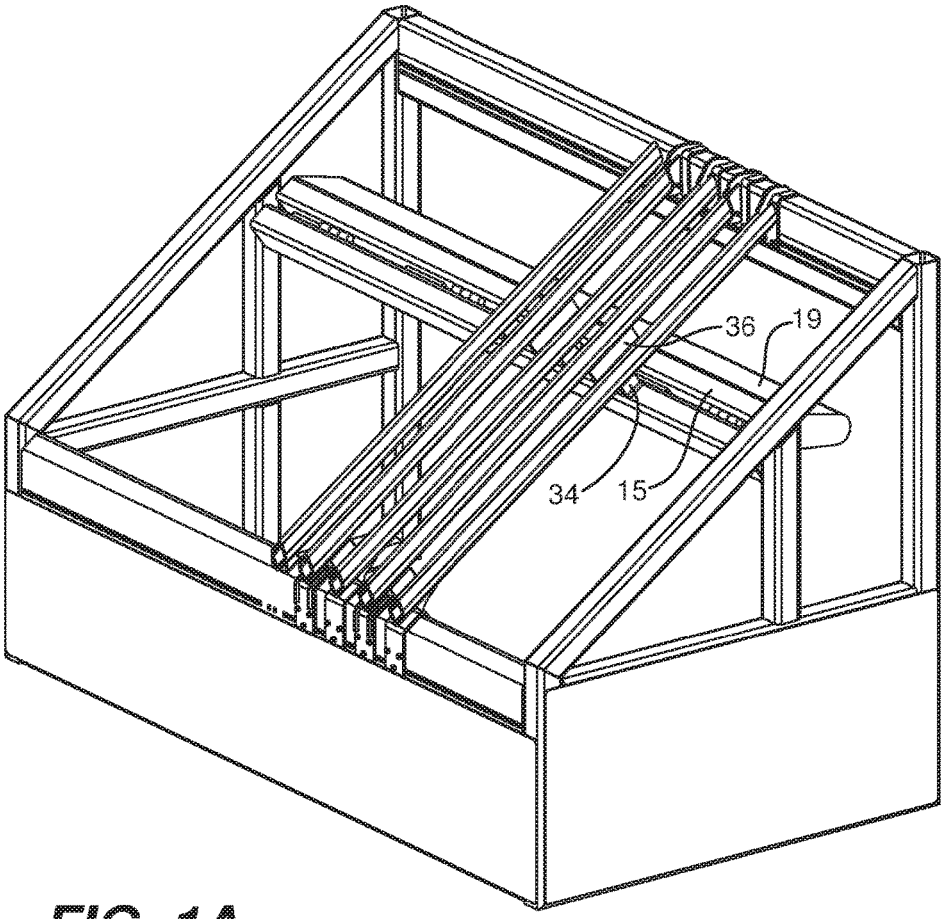
FIGS. 1A and 1B show the material separator with its deck bars in different positions, used to free rocks from the separator.
Figure 1B:
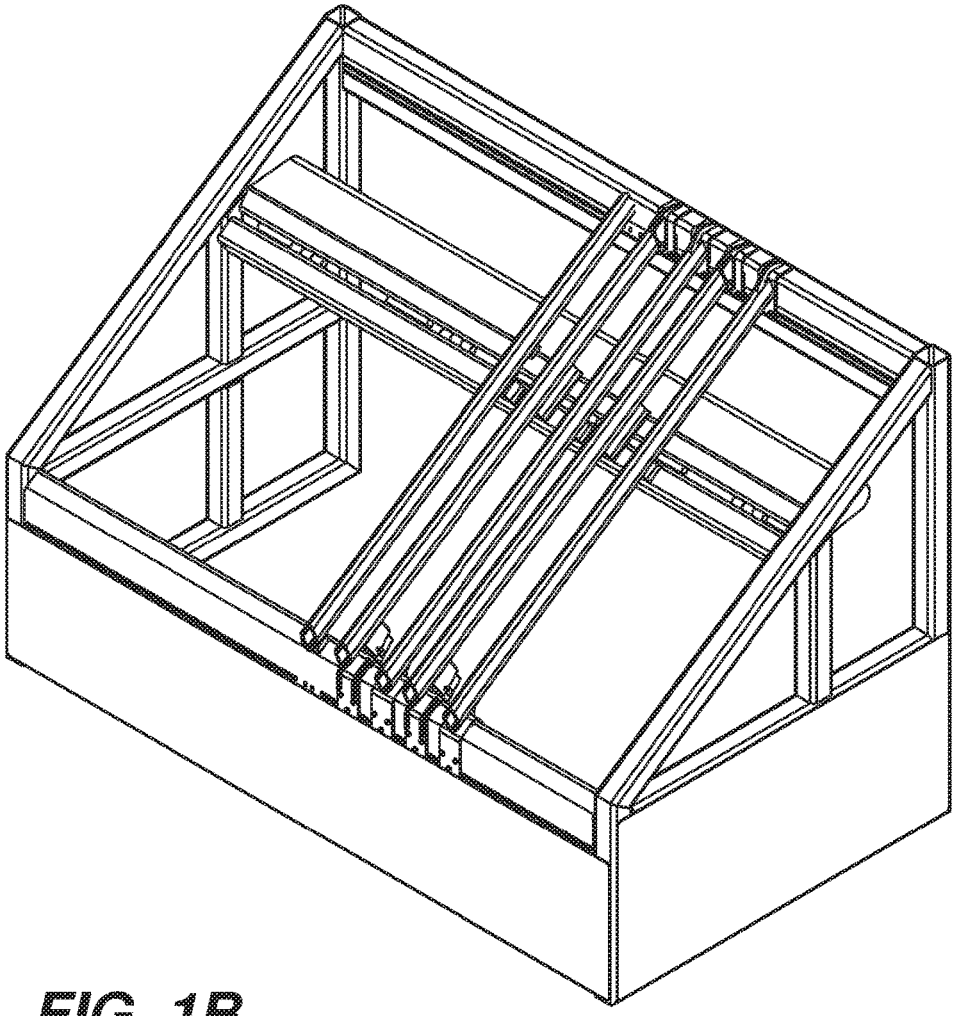

Some of the deck bars, fixed bars 18A, are fixedly mounted to the supporting frame so as to resist upward movement (their lateral position can be adjusted, as will be discussed below.) The fixed bars 18A alternate with shift bars 18B, which are mounted to move vertically relative to the supporting frame as will be described in detail below. It is generally preferred that every other bar is a shift bar, as shown in FIGS. 1-1B. This allows adjacent deck bars to be offset from each other vertically, as shown, e.g., in FIG. 3E, to free material trapped between the bars.

Figure 2:
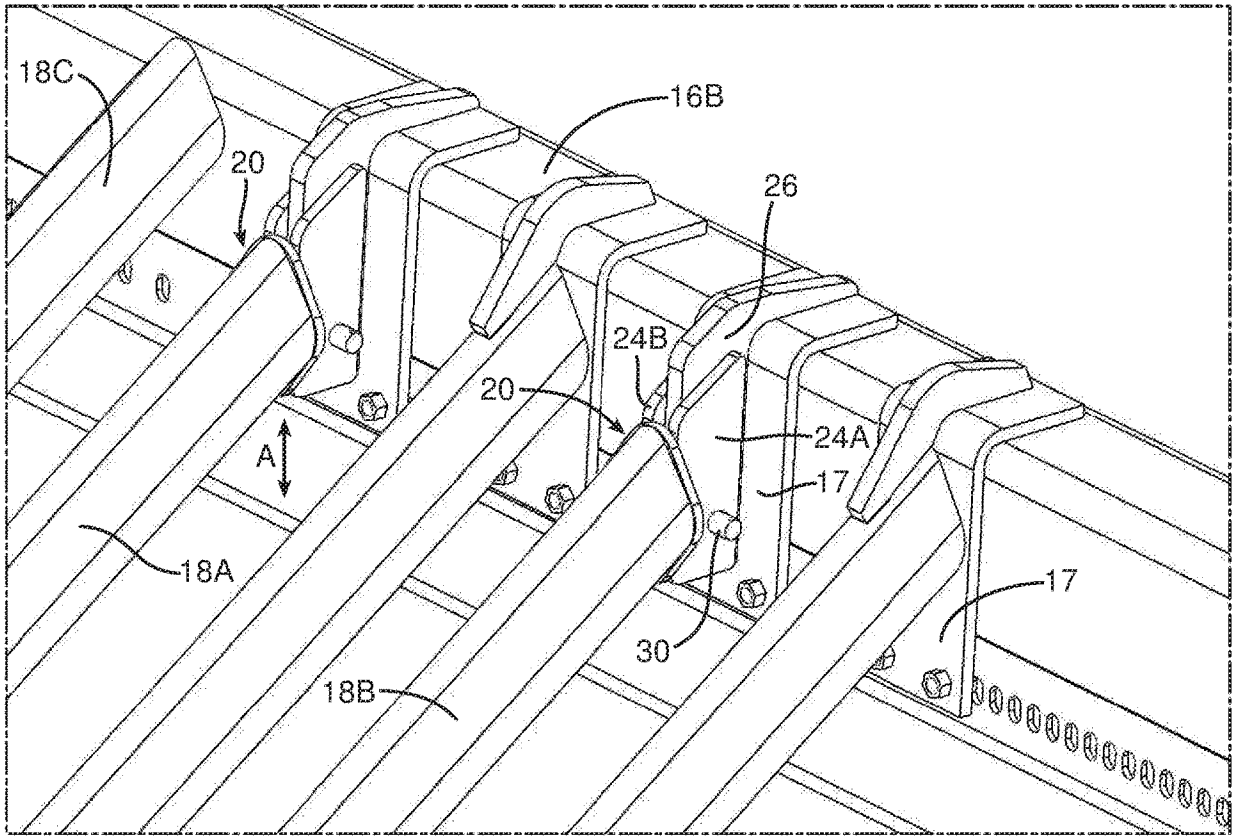
FIG. 2 is an enlarged perspective view of an upper portion of the material separator.
Figure 2A:
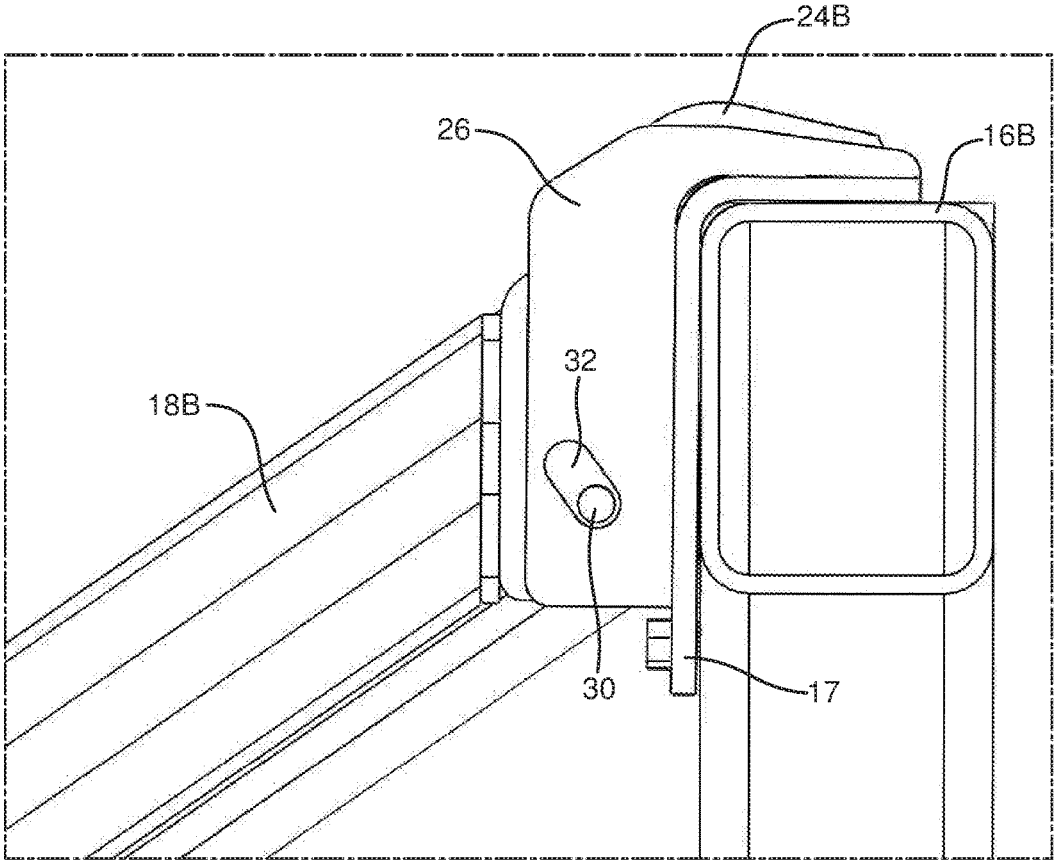
FIG. 2A is a side view of an upper end of one of the shift bars of the material separator, with vertical plate 24A removed so that guide plate 26 can be seen.
Figure 3:
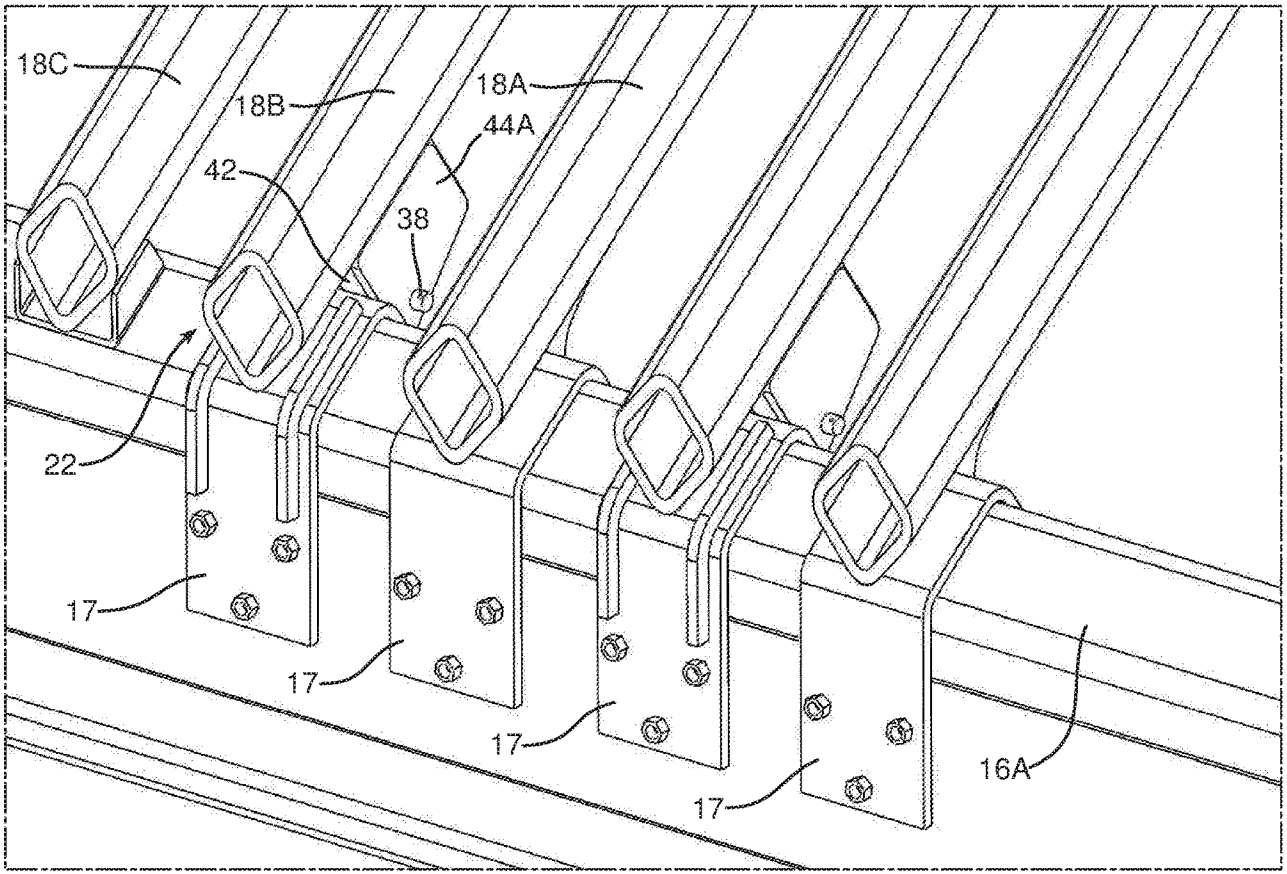
FIG. 3 is an enlarged perspective view of a lower portion of the material separator.
Figure 3A:
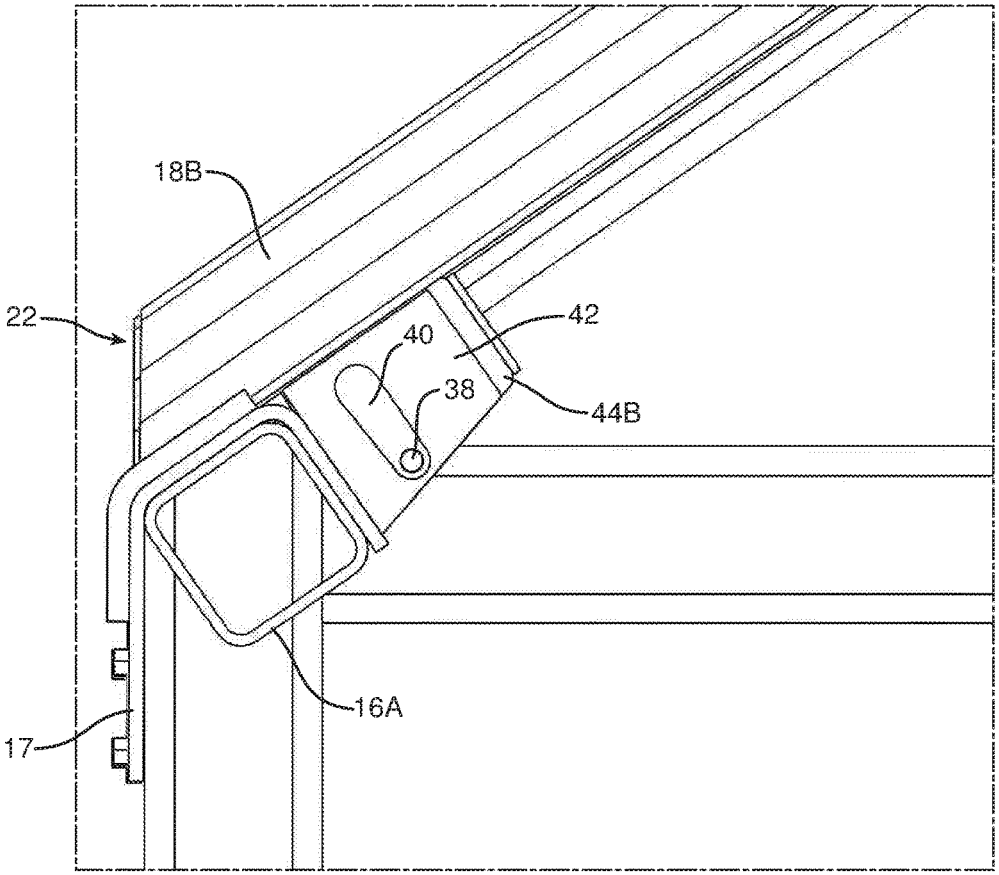
FIG. 3A is a side view of a lower end of one of the shift bars of the material separator with vertical plate 44A removed so that guide plate 42 can be seen.

Referring to FIGS. 2 and 3, the positions of fixed bars 18A and shift bars 18B along the length of frame members 16A and 16B are adjustable by sliding upper and lower deck bar attach plates 17, on which the upper and lower ends of the deck bars are mounted, laterally along the frame members 16A and 16B. The attach plates 17 are bolted in desired positions along the frame members using a row of holes in the frame members, e.g., as shown in FIG. 2. This arrangement also allows deck bars to be selectively removed from or added to the frame if desired.

A fixed central bar 18C is welded to the frame at its upper and lower ends. Fixed central bar 18C enhances the racking strength and structural integrity of the frame, and serves as a fixed reference point for lateral adjustment of the fixed bars 18A and shift bars 18B. Fixed central bar 18C also serves as rigid attachment point for a stop 46, as will be discussed below.

Figure 1C:
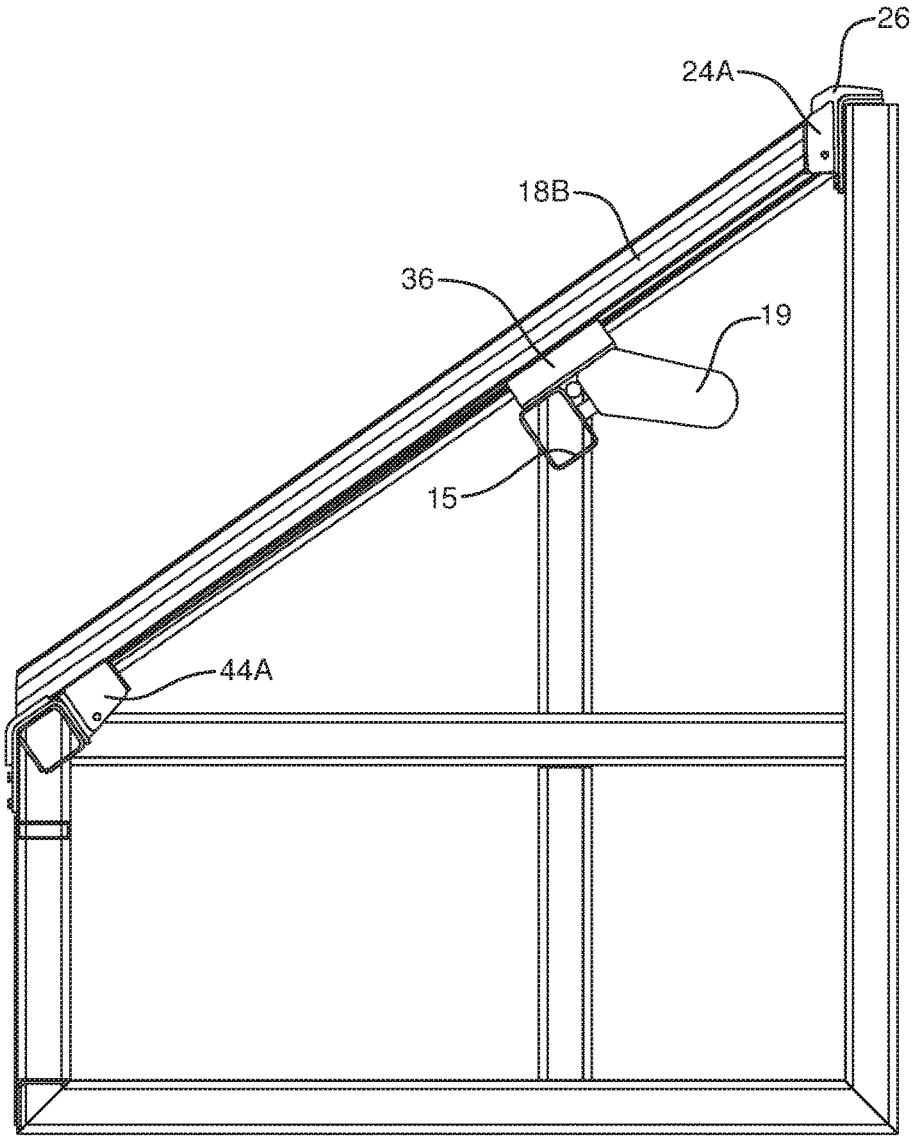
FIG. 1C is a side view of the material separator in its rest position, with a portion of the frame removed for clarity.
Figure 1D:
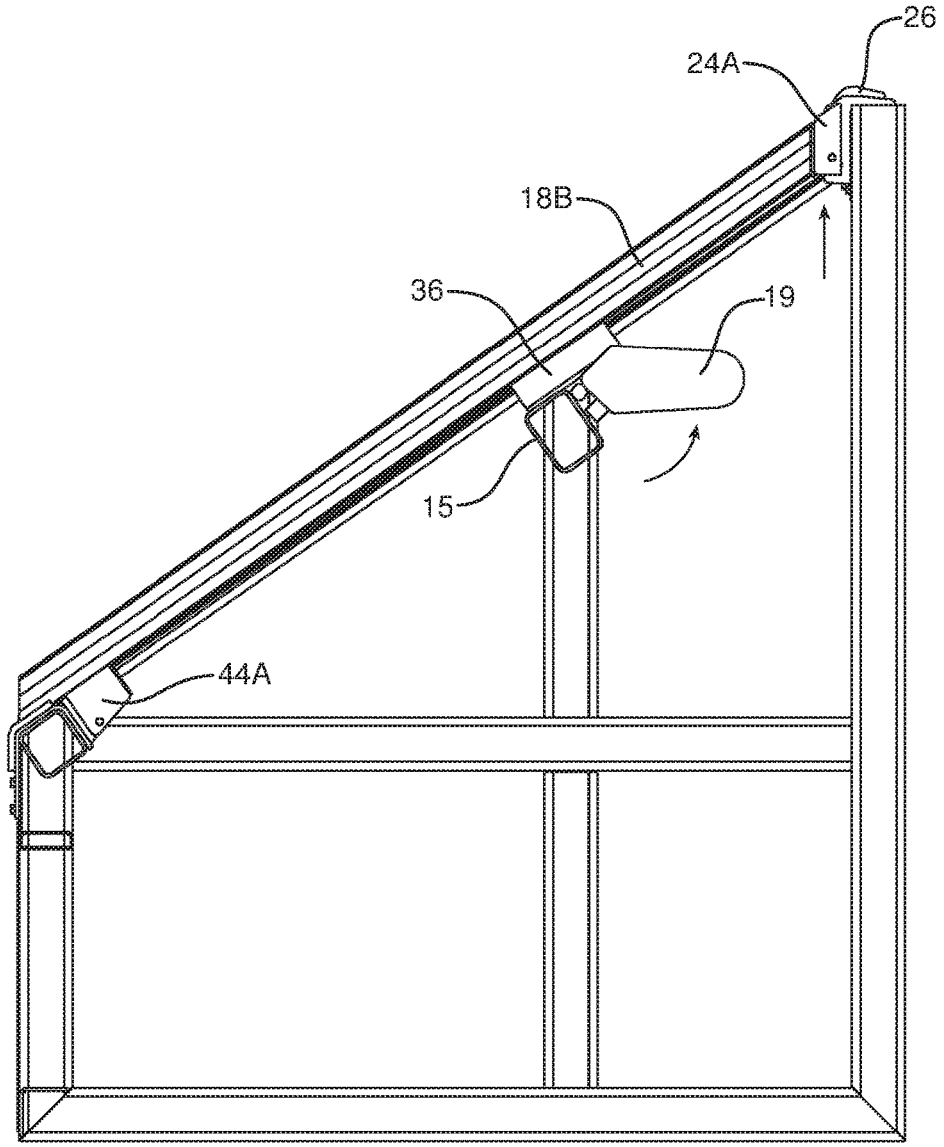
FIGS. 1D and 1E are side views showing the material separator in its two raised positions (corresponding to FIGS. 1A and 1B).
Figure 5:
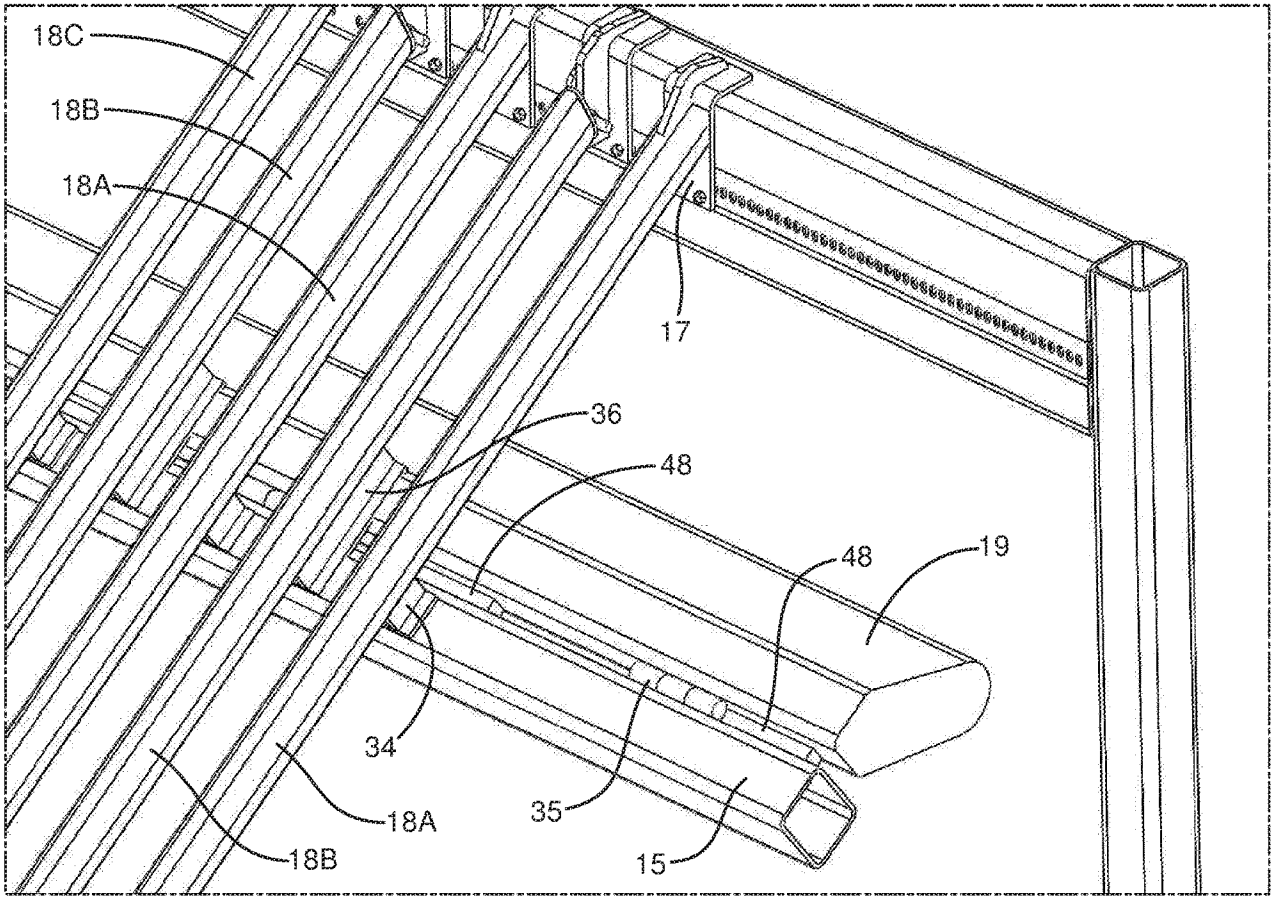
FIG. 5 is an enlarged top perspective view showing the bars, T supports, deck bar support and shift bar actuator.
Figure 6:
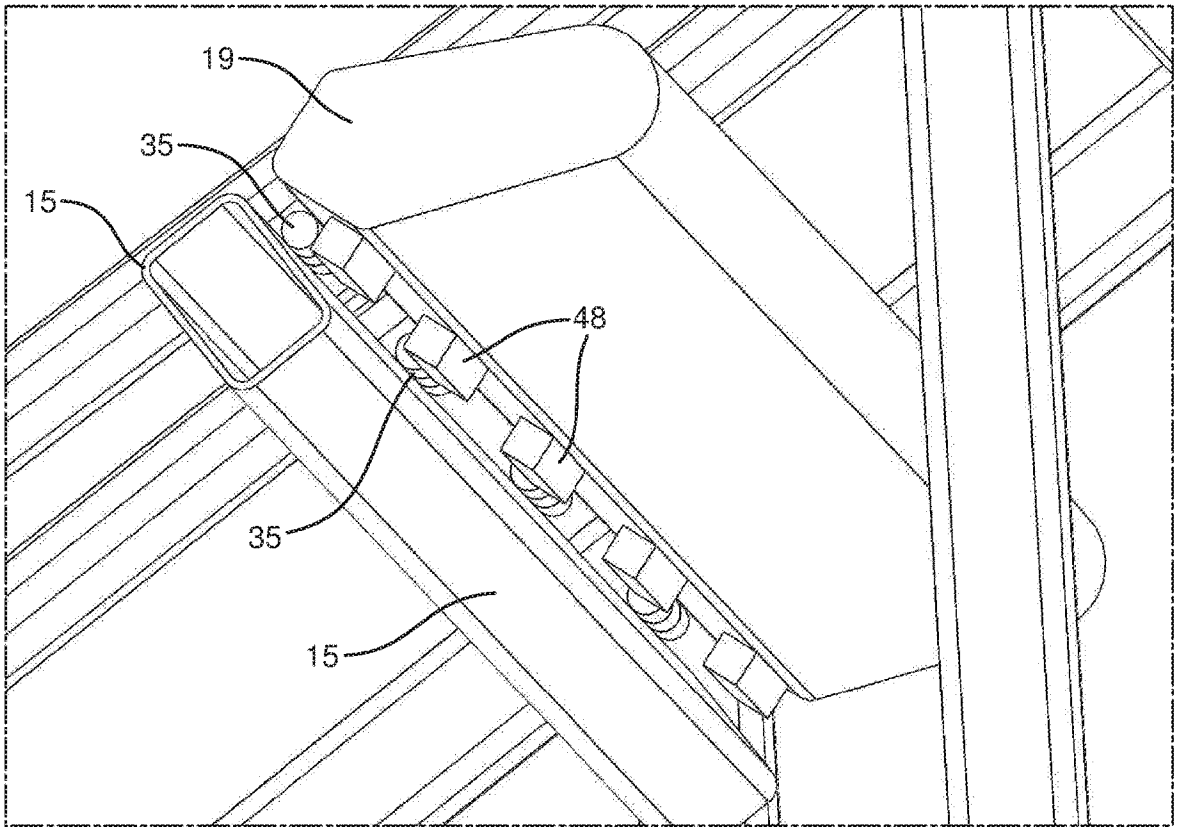
FIG. 6 is an enlarged perspective view of the shift bar actuator and deck bar support seen from below, in a raised position, showing an arrangement of hinges and stops according to one implementation.

As shown in FIGS. 1C and 5B, and as will be discussed in further detail below, the fixed bars 18A include short T-supports 34 that are supported from below by a fixed (e.g., welded in place) deck bar support 15, and the shift bars 18B include longer T-supports 36 that are supported by both the deck bar support 15 and a shift bar actuator 19 that is pivotably mounted on the deck bar support by hinges 35, as shown in FIG. 6. T-supports 34 and 36 are rigid support members that have a T-shaped cross-section, with the cross-bar of the T contacting the upper surface of the deck bar support—and in the case of the T-supports 36 the upper surface of the shift bar actuator as well. A plurality of hinges 35 are provided, spaced along the length of the shift bar actuator, to provide smooth pivoting of the shift bar actuator about the deck bar support and to distribute forces.

When actuated, e.g., by upward pressure applied by the bucket of a loader, the shift bar actuator 19 pivots about the deck bar support and presses up on the T-supports 36, causing the shift bars to move in a two-stage sequence. Because the T-supports 34 are shorter, and do not contact the shift bar actuator, the shift bar actuator can pivot freely without being impeded by the fixed bars.

Figure 2B:
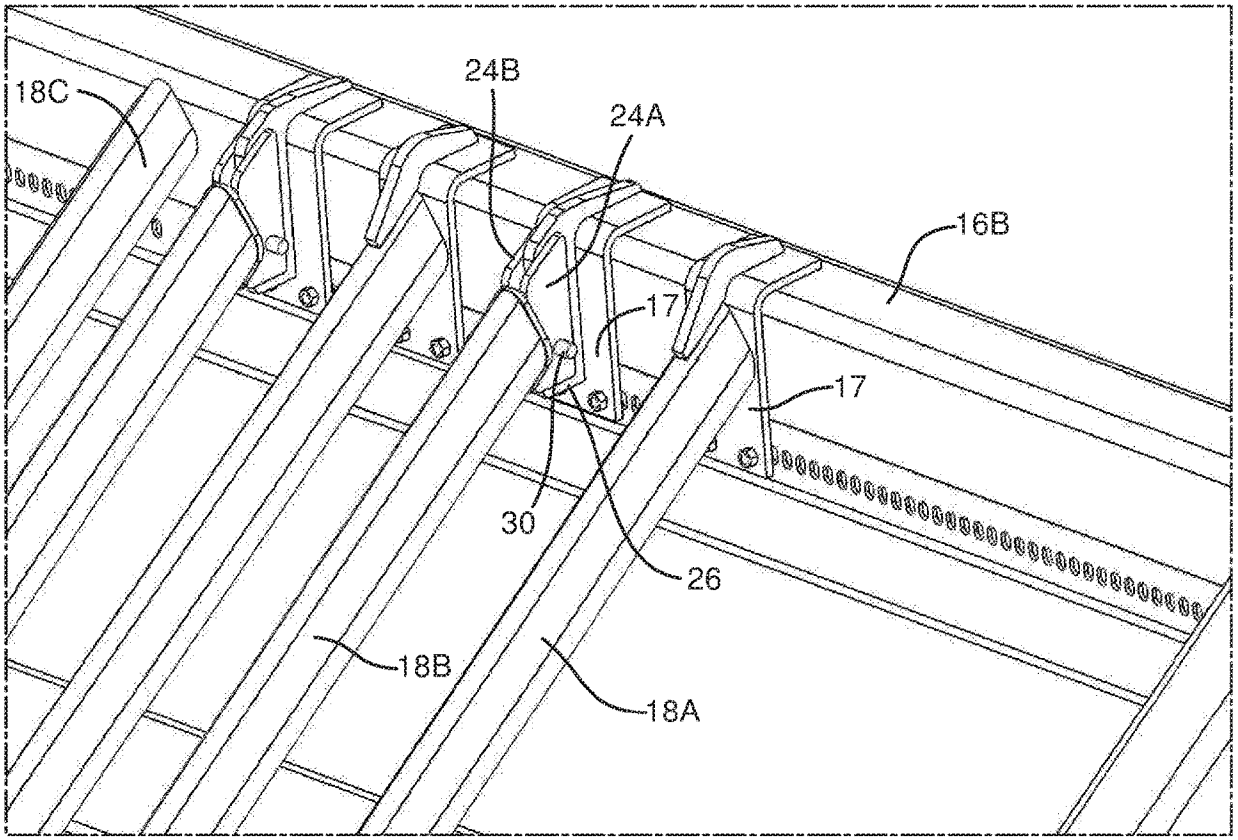
FIG. 2B is a perspective view of the upper portion of the separator with the upper ends of the shift bars displaced upward.
Figure 2C:
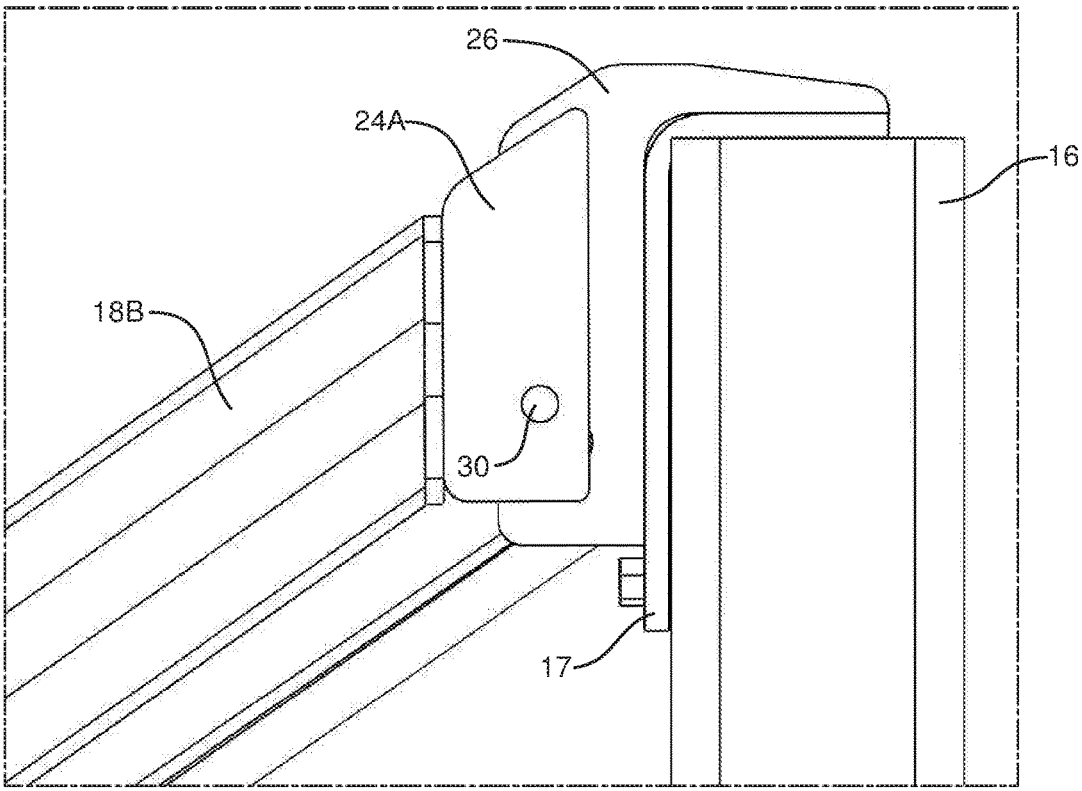
FIG. 2C is a side view of the upper end of the shift bar in its vertically displaced position.
Figure 3B:
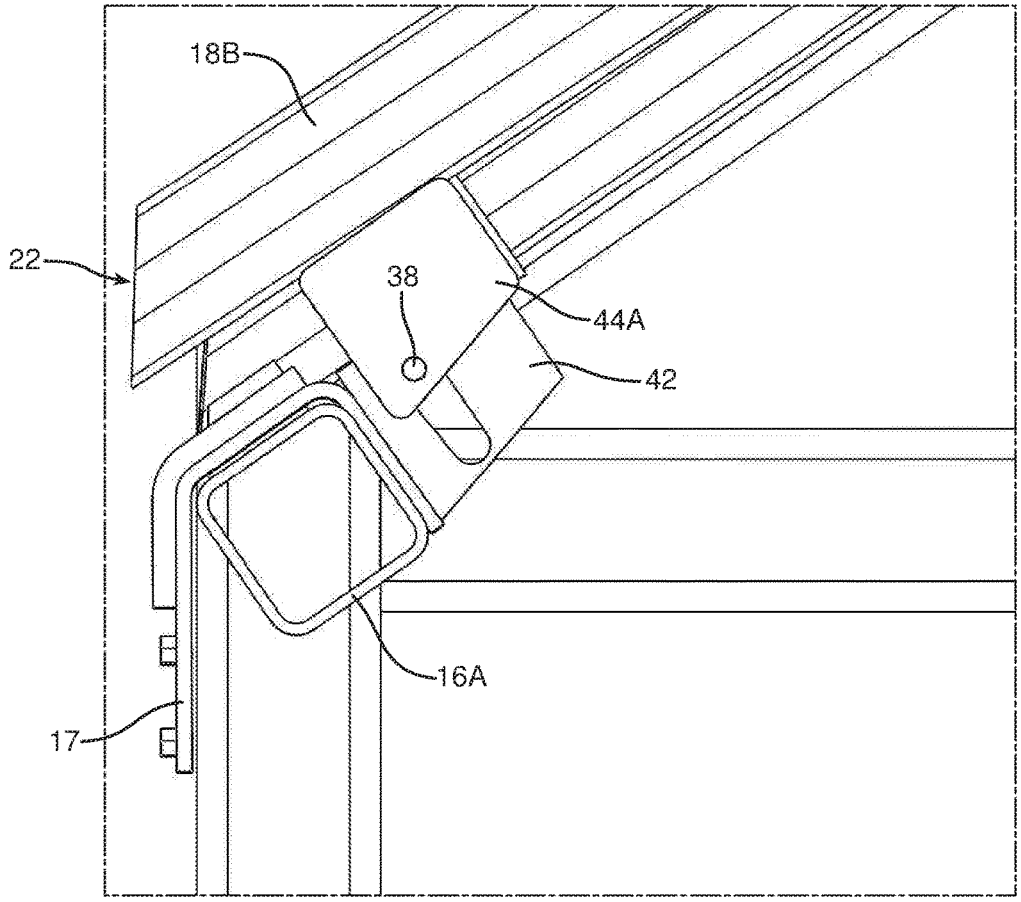
FIG. 3B is a side view of the lower end of the shift bar in a raised position.
Figure 3C:
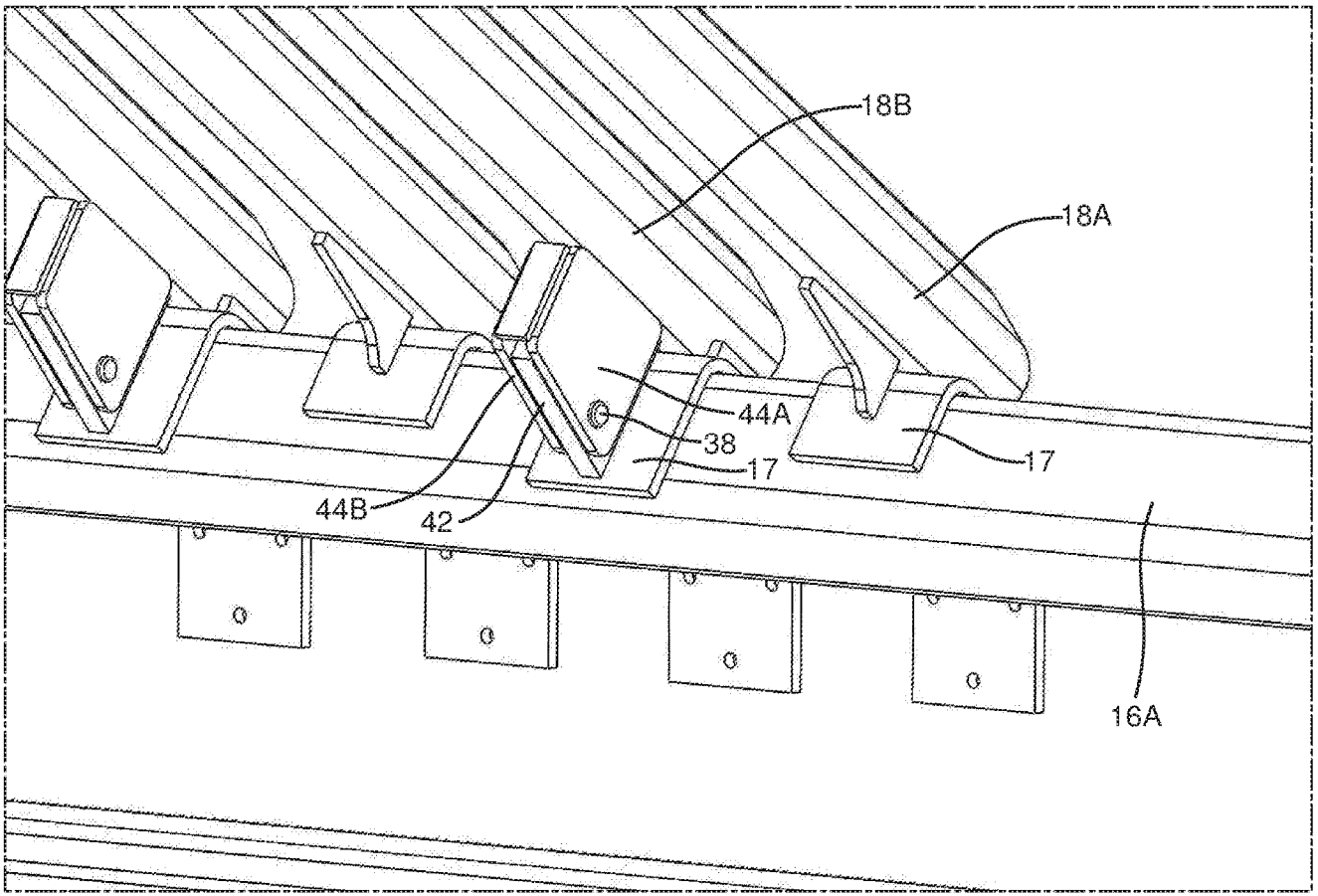
FIGS. 3C and 3D are perspective views taken from behind the shift bars, showing the shift bars in the lowered (rest) and raised positions, respectively.
Figure 3D:
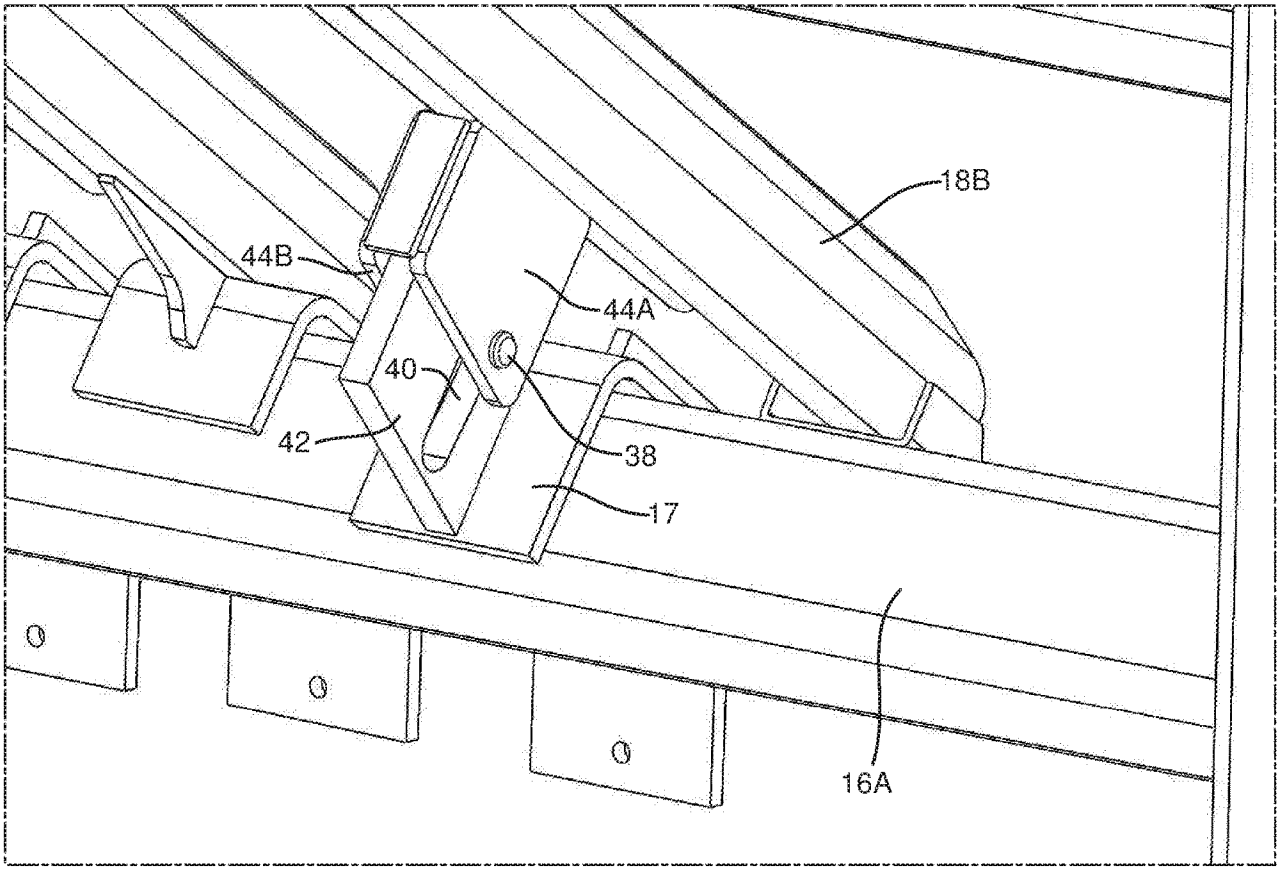

During the first stage, the upper ends 20 of the shift bars translate vertically (FIG. 1A, FIGS. 2B-2C), while the lower ends remain stationary. As pivoting of the shift bar actuator continues, the lower ends 22 of the shift bars pivot upward about the upper ends during the second stage (FIG. 1B, FIGS. 3B and 3D). This sequence is reversed when the shift bars are allowed to drop back to their rest position. The inventor has found this two-stage movement to be particularly effective in freeing material trapped between the bars.

The two stages of movement will now be discussed in further detail.

Figure 2D:
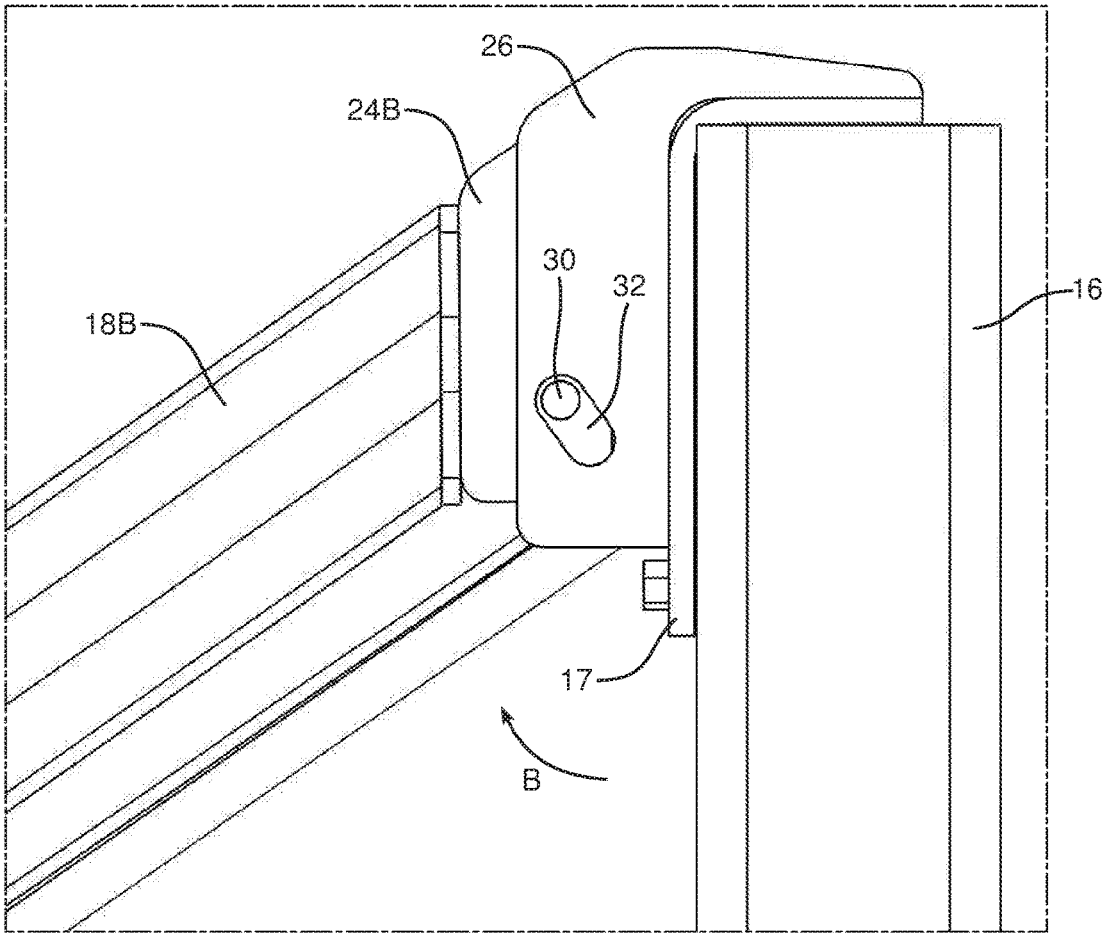
FIG. 2D is the same view with the vertical plate 24A removed so that guide plate 26 can be seen.

Referring now to FIGS. 2-2D, the upper end 20 of each shift bar 18B includes a pair of vertical plates 24A, 24B, that are disposed on opposite sides of a guide plate 26 that is fixedly mounted on upper frame member 16B. As the shift bar actuator rotates upward during the first stage, the upper surface of the shift bar actuator presses up on the longer T-supports 36. This pushes the shift bars upward, causing the vertical plates 24A, 24B to move upward on the guide plate 26, with their movement (Arrow A) being guided by the travel of pin 30 in a slot 32 in the guide plate 26. Once the upper end 20 has reached the upper limit of slots 32, as shown in FIG. 2D, the shift bar 18B will then pivot about the pin 30 (Arrow B), allowing the lower end 22 of the bar to be raised during the second stage.

In some implementations, the vertical displacement of the upper end when the pin tops out in the slot is at least about 0.5 inch, for example, from about 0.5 to 2 inches. The vertical displacement of the shift bars is the first step in freeing debris caught between the bars, and thus it is preferable that the displacement be sufficient to have an effect on the trapped debris. The upper limit to the amount of displacement is generally determined by the length of slot that can be provided in the guide plate without making the size of the guide plate unwieldy.

Figure 1E:
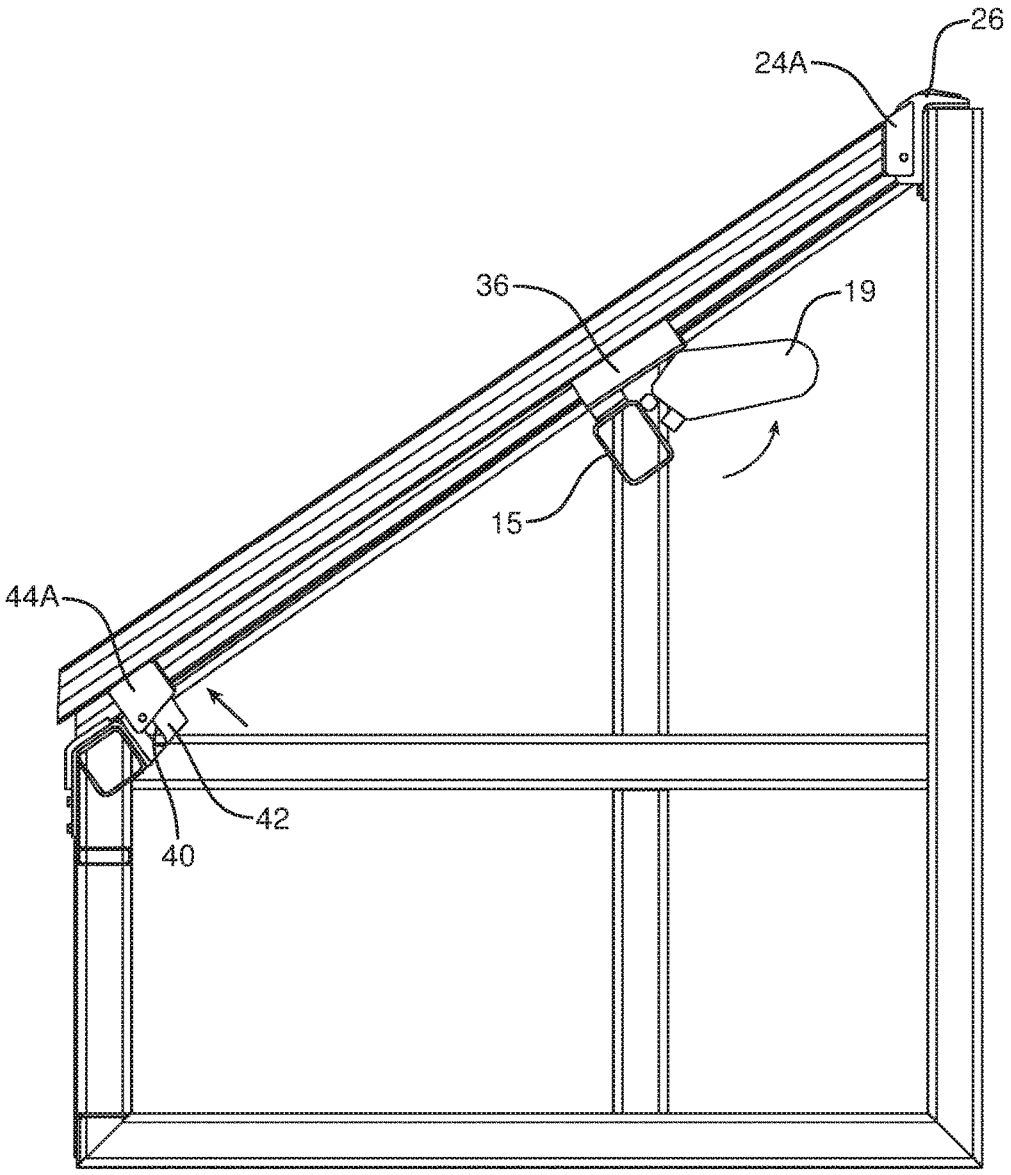
Figure 3E:
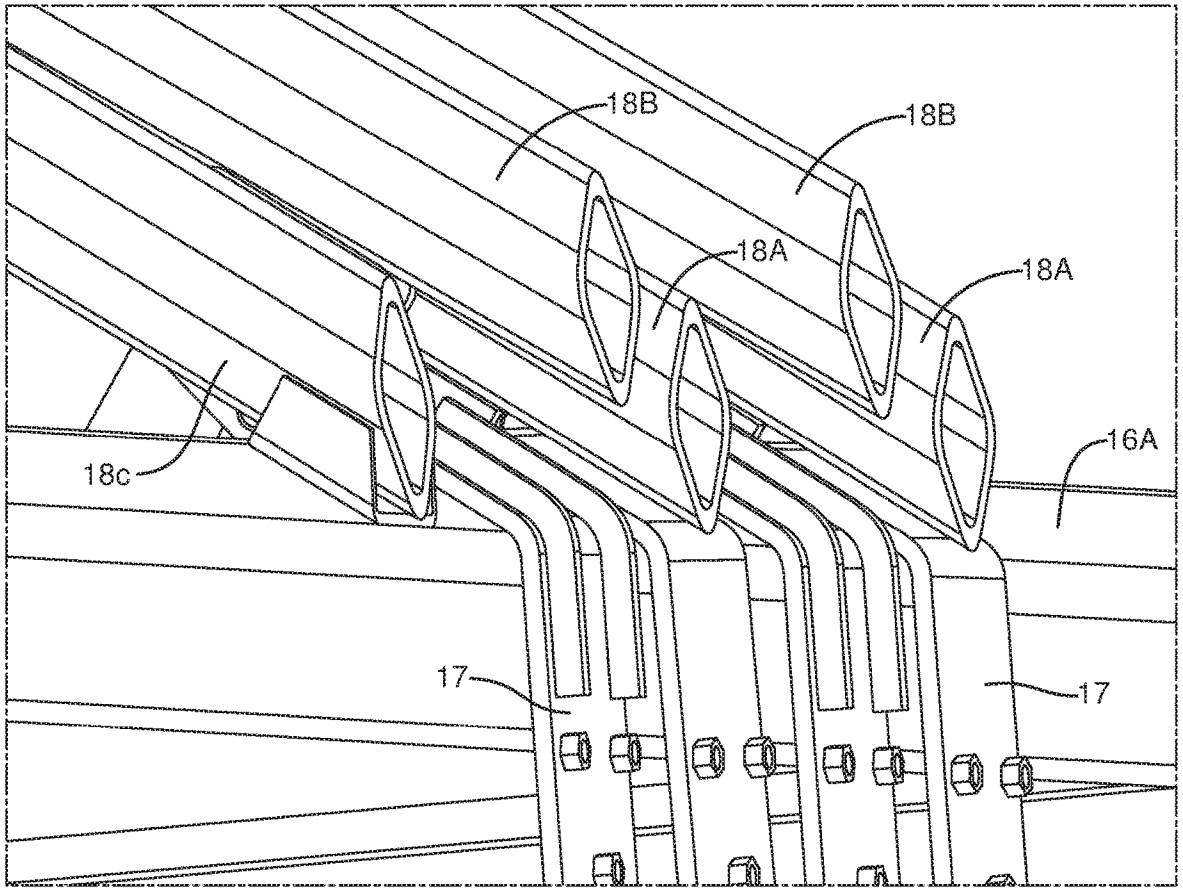
FIG. 3E is an enlarged perspective view showing the lower ends of the deck bars with the shift bars in the raised position.

Referring to FIGS. 3-3B, continued upward rotation of the shift bar actuator 19 during the second stage (as shown, e.g., in FIG. 1E) exerts further upward pressure on T-supports 36, lifting the shift bars higher. Because the shift bars are now pivoting about upper ends 20 via the pins 30, this results in upward movement of the lower ends 22 of the shift bars 18B. The resulting offset of the lower ends of the shift bars relative to the fixed bars is shown in FIG. 3E.

Preferably, the upward movement of the lower ends 22 is significantly greater than the movement of the upper ends, for example twice as much, three times as much, or in some cases even more. In some implementations, the upward movement of ends 22 may be from about 1.5 inches to 6 inches.

The upward movement of ends 22 is guided by the travel of a pin 38 in a slot 40, with the slot being provided in a guide plate 42 that is sandwiched between two vertical plates 44A, 44B, in a manner similar to the arrangement at the upper ends 20. The sandwiching of the guide plates between the vertical plates at the upper and lower ends of the shift bars also serves to maintain the lateral spacing between the shift bars. This is important since the shift bars are not attached to anything along their lengths.

Figure 7:
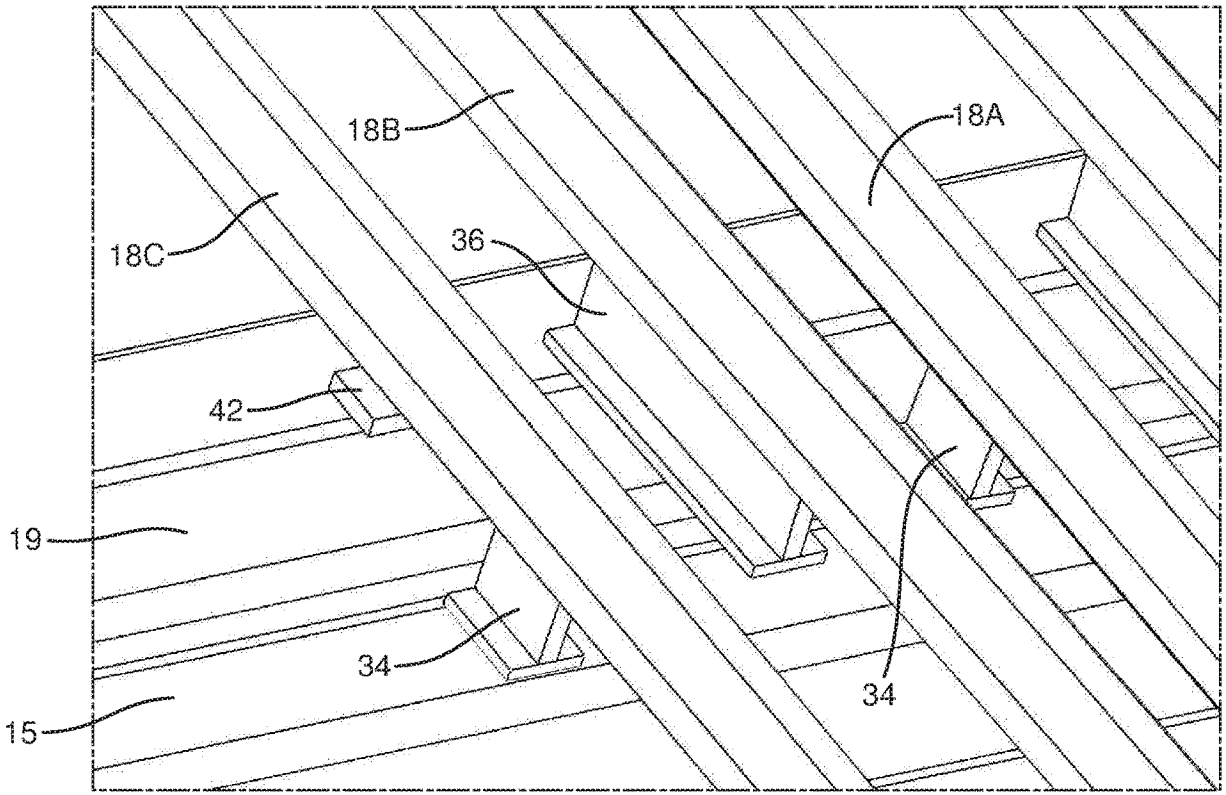
FIG. 7 is an enlarged perspective view of the central fixed bar, a shift bar and a fixed bar, showing the stop on the central fixed bar.

It is noted that it is not the end of the slot 40 that limits upward travel of the ends 22. Instead, pivoting of the shift bars 18B is limited by engagement of the shift bar actuator 19 with a stop 46 (FIG. 7) that extends downwardly from a lower surface of the fixed central bar 18C. The stop 46 typically extends about 0.5 to 4 inches, e.g., about 1 to 2 inches, downward from the lower surface of the central bar 18C. Stop 46 needs to be at least long enough to prevent the pins 38 from topping out in the slots 40, without being so long as to undesirably inhibit rotation of the shift bar actuator. Using this stop to limit further rotation of the shift bar actuator prevents excessive force from being applied to the lower deck bar attach plates 17, which could occur if the slots 40 were used to stop further pivoting of the shift bars. Rather than stopping upward movement, the engagement of the pins 38 in the slots 40 allows controlled vertical movement of the ends 22 without undesirable lateral displacement.

The height of the T-supports is selected so that the length differential between the T-supports 34 on the fixed bars and the T-supports 36 on the shift bars allows clearance for the shift bar to rotate and lift the shift bars the desired amount without being prevented by contact with the fixed bars. In some implementations, the T-supports have a height (distance from the lower surface of the deck bar to the lower surface of the T-support) of from about 2 to 10 inches, e.g., about 2 to 8 inches.

Once upward movement of the shift bars has stopped, the operator will release the upward pressure of the bucket. The shift bar actuator 19 will then return to its rest position, with the movement sequence of the shift bars reversing. Stops 48 (FIG. 6), positioned along the length of the surface of the shift bar actuator 19 that faces the deck bar support 15, prevent over-rotation of the shift bar actuator 19 towards the deck bar support 15 and provide the shift bar actuator with a stable rest position in which its lower surface can be easily engaged by a bucket and its upper flat surface is flush with the bottom surface of the T-supports 36. The rest position is also configured to allow sufficient clearance between the ground and the lower surface of the shift bar actuator to accommodate large sized buckets.

If desired, the operator can repeat the lifting and lowering action multiple times, resulting in a rocking action of the shift bars that can assist with freeing of trapped material.

Figure 4:
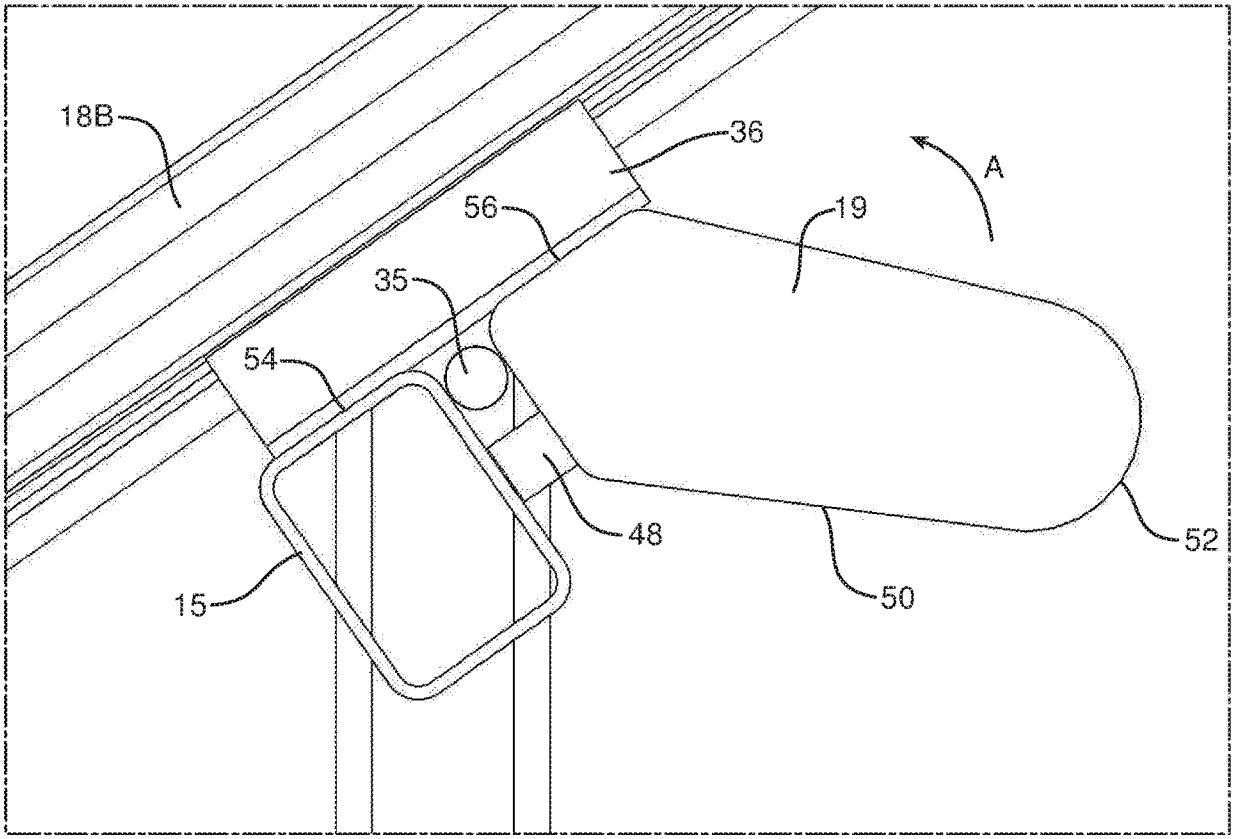
FIG. 4 is an enlarged side view of the shift bar actuator portion of the material separator in the rest position.
Figure 4A:
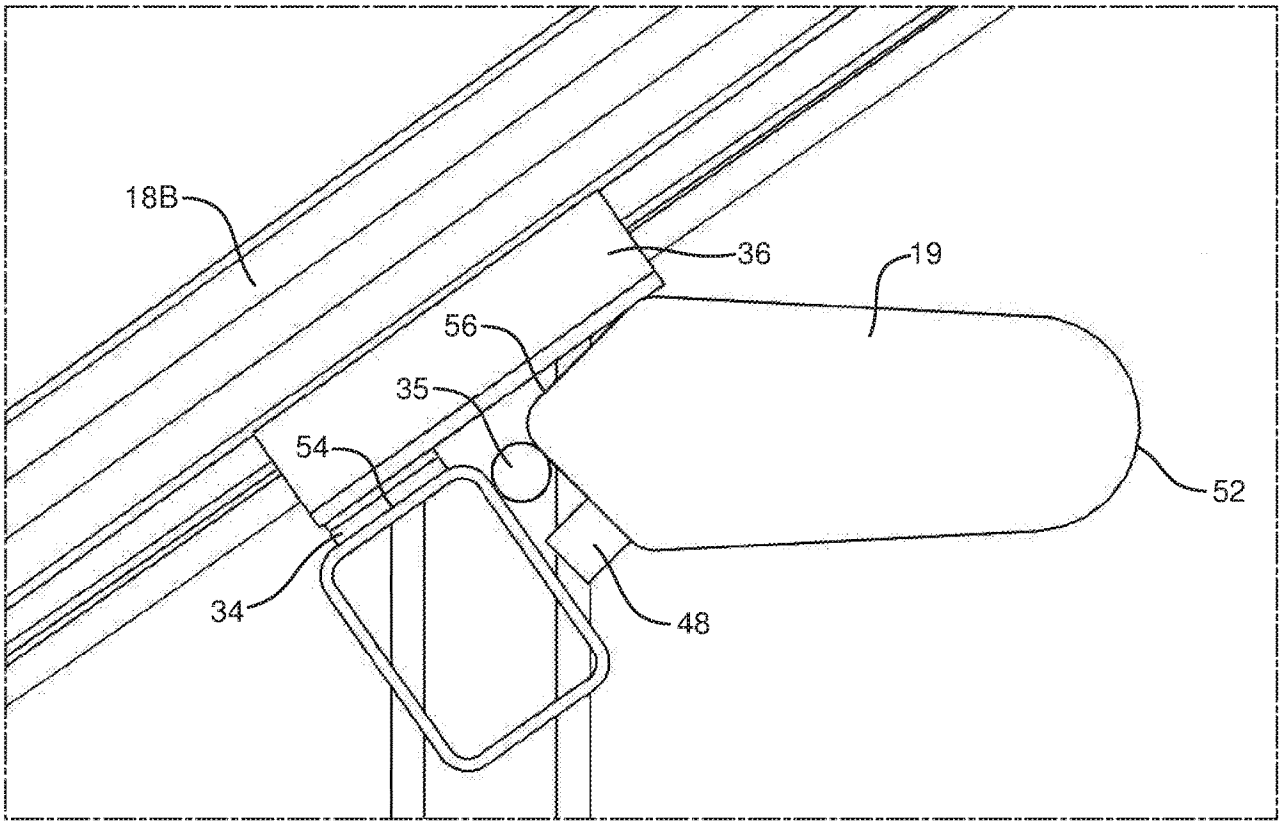
FIGS. 4A and 4B show the shift bar actuator in its two raised positions, corresponding to the positions of the separator shown in FIGS. 1D and 1E.
Figure 4B:
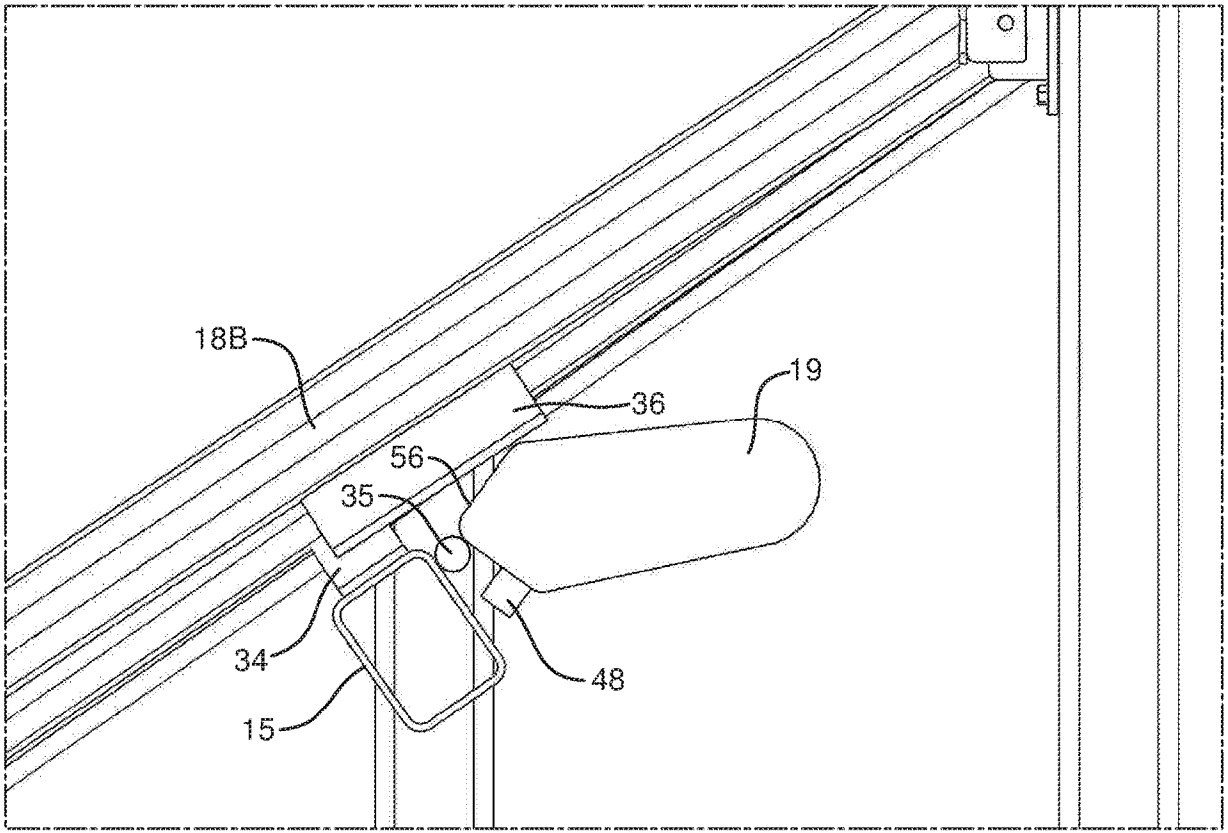

The upward movement of the shift bars, in both stages, is actuated by the shift bar actuator 19, as discussed above. The shift bar actuator 19 and the deck bar support 15 are shown in detail in FIGS. 4-4B and 5-5B. As shown in FIGS. 4-4B, when the lower surface 50 or curved end surface 52 of the shift bar actuator is contacted by a bucket (not shown), the shift bar actuator pivots in the direction indicated by Arrow A in FIG. 4. In some implementations, the first pivoted position (which corresponds to the end of the first stage in which the upper ends 20 move upward), the angle between the flat upper surface 54 of the deck bar support 15 and the flat upper surface 56 of the shift bar actuator 19 is from about 5 to 15 degrees, while the angle is from about 15 to 25 degrees in the second pivoted position when the stop 46 engages the shift bar actuator.

The end surface 52 of the shift bar actuator is generally curved (arcuate), as shown, to provide good contact with the bucket regardless of the attitude of the bucket during contact, and to prevent denting of the shift bar actuator by the bucket.

The shift bar actuator 19, and the deck bar support 15 on which it is mounted, are positioned closer to the upper ends 20 of the bars than to the lower ends 22. In some implementations, the shift bar actuator is positioned with about 30 to 48% of the length of the bars above the shift bar actuator, e.g., with about 35 to 45% of the length of the bars above the shift actuator. This positioning facilitates the preferential upward movement of the upper ends 20 during the first stage of movement, prior to lifting of the lower ends 22.

Advantageously, none of the shift bars are bolted to the shift bar actuator; instead, the shift bars are independent of one another, and are not attached to anything along their lengths (they are only attached to the frame at ends 20 and 22.) Because of this, the number of bars and/or the positions of the fixed bars and shift bars along the width of the frame can be easily adjusted, simply by unbolting the attach plates 17 from the frame members.

In preferred implementations, sufficient clearance is provided between the vertical plates and guide plates to allow for tolerance issues and also to accommodate material being caught in the gaps between the plates.

OTHER EMBODIMENTS

In some implementations, the pins at the lower ends of the shift bars can be omitted. While advantageous for preventing the ends of the shift bars from being displaced laterally when the lower ends drop, these pins are not essential to the functioning of the separator.

While a plurality of stops 48 are shown, fewer stops, or even a single stop, can be used to position the shift bar actuator relative to the deck bar support in the rest position.

If ease of adjustability is desired, but not the rocking action shown in FIGS. 1-1B, the manner in which the shift bars are mounted on the separator (independent of one another and not connected to each other anywhere along their length) can be utilized with a separator that does not include vertically displaceable upper bar ends. In other words, if desired the upper bar ends can be mounted to allow pivoting of the lower bar ends without the additional vertical movement of the upper bar ends.

In the implementation shown in the figures and described above, every other bar is a shift bar. This arrangement is generally preferred, for optimizing the self-cleaning action of the separator. However, if desired more or fewer of the bars can be shift bars.

Accordingly, other embodiments are within the scope of the following claims.

What is claimed is:

1. A material separator comprising:

a supporting frame;

a screening surface mounted at an incline on the supporting frame, the screening surface comprising a plurality of fixed bars that are attached to the frame in a manner to resist upward movement, and a plurality of shift bars that are attached to the frame at their upper and lower ends, in a manner to allow upward movement; and a shift bar actuator, positioned between the upper and lower ends of the shift bars, the shift bar actuator being configured to impart a two-stage movement to the shift bars, whereby during a first stage the upper ends are first displaced vertically, and during a second stage the lower ends pivot upward about the upper ends.

2. The material separator of claim 1 wherein each of the upper ends of the shift bars includes a guide plate that is interposed between a pair of vertical plates that are mounted on the frame, and the guide plate moves upward relative to the vertical plates during the first stage.

3. The material separator of claim 2 wherein at the end of the first stage further upward movement of each of the upper ends is prevented by a pin that extends through the guide plate and vertical plates, and about which pivoting occurs during the second stage.

4. The material separator of claim 1 wherein the shift bar actuator is positioned closer to the upper ends of the shift bars than the lower ends.

5. The material separator of claim 1 wherein the shift bar actuator is pivotably mounted on a deck bar support member that is welded to the frame, and the shift bar actuator is configured to pivot upward relative to the deck bar support member in response to a force applied to a lower surface of the shift bar actuator.

6. The material separator of claim 5, further comprising T-supports mounted on lower surfaces of the shift bars and fixed bars, each T-support having a length that extends substantially perpendicular to the length of the deck bar support and a cross-bar positioned to contact an upper surface of the deck bar support when the shift bars are in a rest position.

7. The material separator of claim 6, wherein the T-supports mounted on the shift bars are longer than the T-supports mounted on the fixed bars to an extent that the T-supports on the shift bars also contact the shift bar actuator, while the T-supports on the fixed bars only contact the deck bar support.

8. The material separator of claim 5 wherein the shift bar actuator is pivotably mounted on the deck bar support member by a plurality of hinges positioned along the length of the shift bar actuator.

9. The material separator of claim 5, further comprising one or more stop(s) positioned to prevent the shift bar actuator from contacting the deck bar support member when the shift bar actuator is returned to a rest position.

10. The material separator of claim 1 further comprising a fixed central bar that is welded to the frame, and a stop extending downwardly from the fixed central bar to limit upward movement of the shift bar actuator.

11. The material separator of claim 2 wherein the vertical plates extend from attach plates that are bolted to the frame to allow adjustment of the lateral positioning of the upper ends of the shift bars.

* * * * *